US006220868B1

(12) United States Patent
Pei et al.

(10) Patent No.: US 6,220,868 B1
(45) Date of Patent: Apr. 24, 2001

(54) CARD EDGE CONNECTOR

(75) Inventors: Wen-Chun Pei, Taipei; Yao-Chi Huang, Yung-Ho, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/333,618

(22) Filed: Jun. 15, 1999

(30) Foreign Application Priority Data

Dec. 28, 1998 (TW) ..... 87221648

(51) Int. Cl.[7] ..... H01R 12/00
(52) U.S. Cl. ..... 439/60; 439/637
(58) Field of Search ..... 439/60, 637

(56) References Cited

U.S. PATENT DOCUMENTS 5,842,885 * 12/1998 Takamoto et al. ..... 439/607
5,848,920 * 12/1998 Klein et al. ..... 439/885
5,919,064 * 7/1999 Petersen et al. ..... 439/637
5,941,715 * 8/1999 Huang ..... 439/60
6,000,950 * 12/1999 Kajinuma ..... 439/60
6,059,611 * 5/2000 Davis et al. ..... 439/637

* cited by examiner

*Primary Examiner*—Khiem Nguyen
(74) *Attorney, Agent, or Firm*—Wei Te Chung

(57) ABSTRACT

A card edge connector comprises an insulative housing having a mating face and a mounting face and a plurality of different kinds of conductive contacts. The housing defines an elongate slot in the mating face for receiving a mating edge of a circuit board having an unequal number of conductive pads on opposite faces of the mating edge. The housing also defines a plurality of aligned, transverse cavities on each side thereof for receiving the different kinds of conductive contacts therein. At least two kinds of different contacts are received in the transverse cavities of one side of the housing and a smaller number of contacts are received in the cavities of the opposite side of the housing.

1 Claim, 6 Drawing Sheets

CARD EDGE CONNECTOR

BACKGROUND OF THE INVENTION

The present invention relates to a connector, and more particularly to a card edge connector including different kinds of conductive contacts.

U.S. Pat. Nos. 5,609,502 and 5,024,609 disclose two kinds of card edge connectors. Referring to FIGS. 5, and 6, such connector 70 (80) includes a housing 71 (81) and a plurality of contacts 72 (82, 83). The housing 71 (81) defines two rows of identical transverse cavities 73, 74 (84, 85) for receiving the corresponding contacts 72 (82, 83) therein. The connectors 70, 80 can't be properly attached to a circuit board 6 having a mating edge 60 and first contact pads 62, 63 formed on one face and second contact pads 61 formed on an opposite face because the contacts 72 (82, 83) are symmetrically received in the transverse cavities 73, 74 (84, 85). Thus, an improved card edge connector that can be attached to the circuit board 6 is provided by the present invention.

BRIEF SUMMARY OF THE INVENTION

An object of the present invention is to provide a card edge connector asymmetrically receiving different kinds of contacts in opposite sides of a housing thereof.

Another object of the present invention is to provide a card edge connector with several signal and power contacts thereby promoting proper electrical signal transfer though the connector.

Accordingly, a card edge connector in accordance with the present invention comprises an insulative housing and different kinds of conductive contacts. The housing includes a mating face and a mounting face. The housing defines an elongate slot in the mating face for receiving a mating edge of a circuit card having a plurality of conductive pads formed on opposite faces of the mating edge. The housing defines a plurality of transverse cavities aligned on each side thereof for receiving the conductive contacts therein. At least two kinds of different contacts are received in the transverse cavities of one side of the housing and a smaller number of different contacts are received in the cavities of an opposite side of the housing.

Other objects, advantages and novel features of the invention will become more apparent from the following detailed description of the preferred embodiment when taken in conjunction with the accompanying drawings.

DETAILED DESCRIPTION OF THE INVENTION

Figure 1:
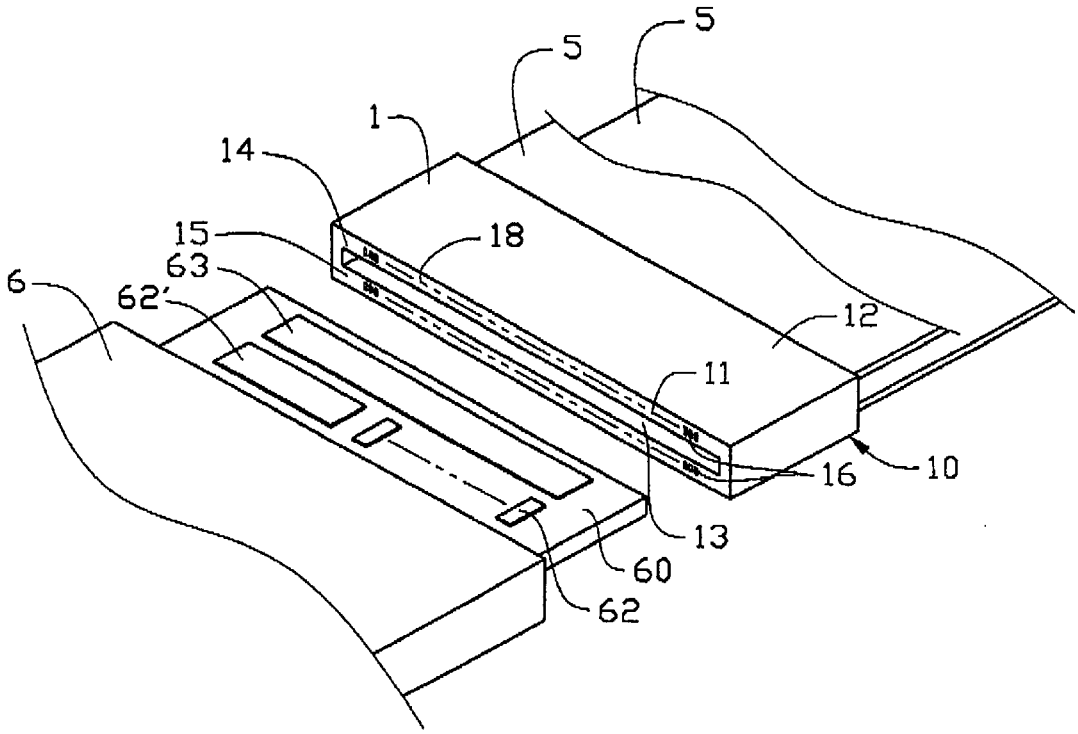
FIG. 1 is a perspective view of a connector of the present invention and a circuit board before being engaged.
Figure 2:
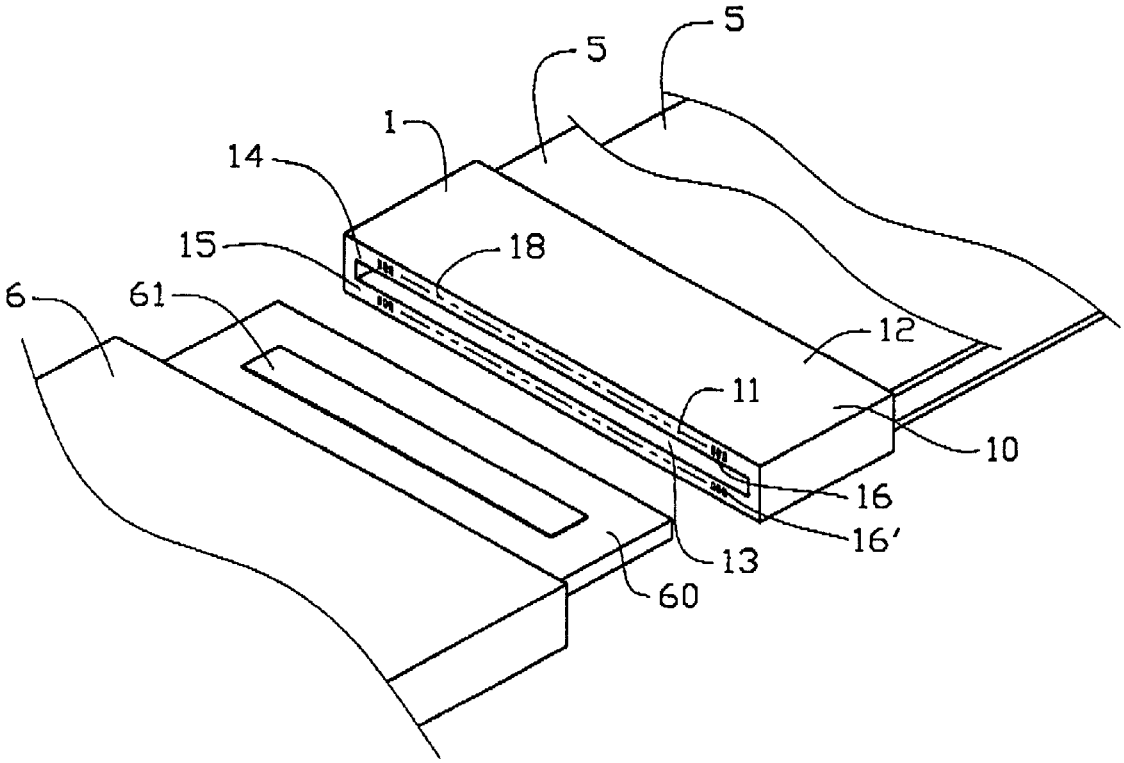
FIG. 2 is similar to FIG. 1 but taken from a different perspective.

Referring to FIGS. 1 and 2, a card edge connector 10 of the present invention engages a circuit board 6 and flexible circuit boards 5 for transferring electrical signals therebetween. The circuit board 6 forms a mating edge 60 having two rows of contact pads 62 (62'), 63 disposed on a side thereof for transferring electrical signals and power signals, respectively, and a row of contact pads 61 disposed on an opposite thereof acting as grounding pads.

Figure 3:
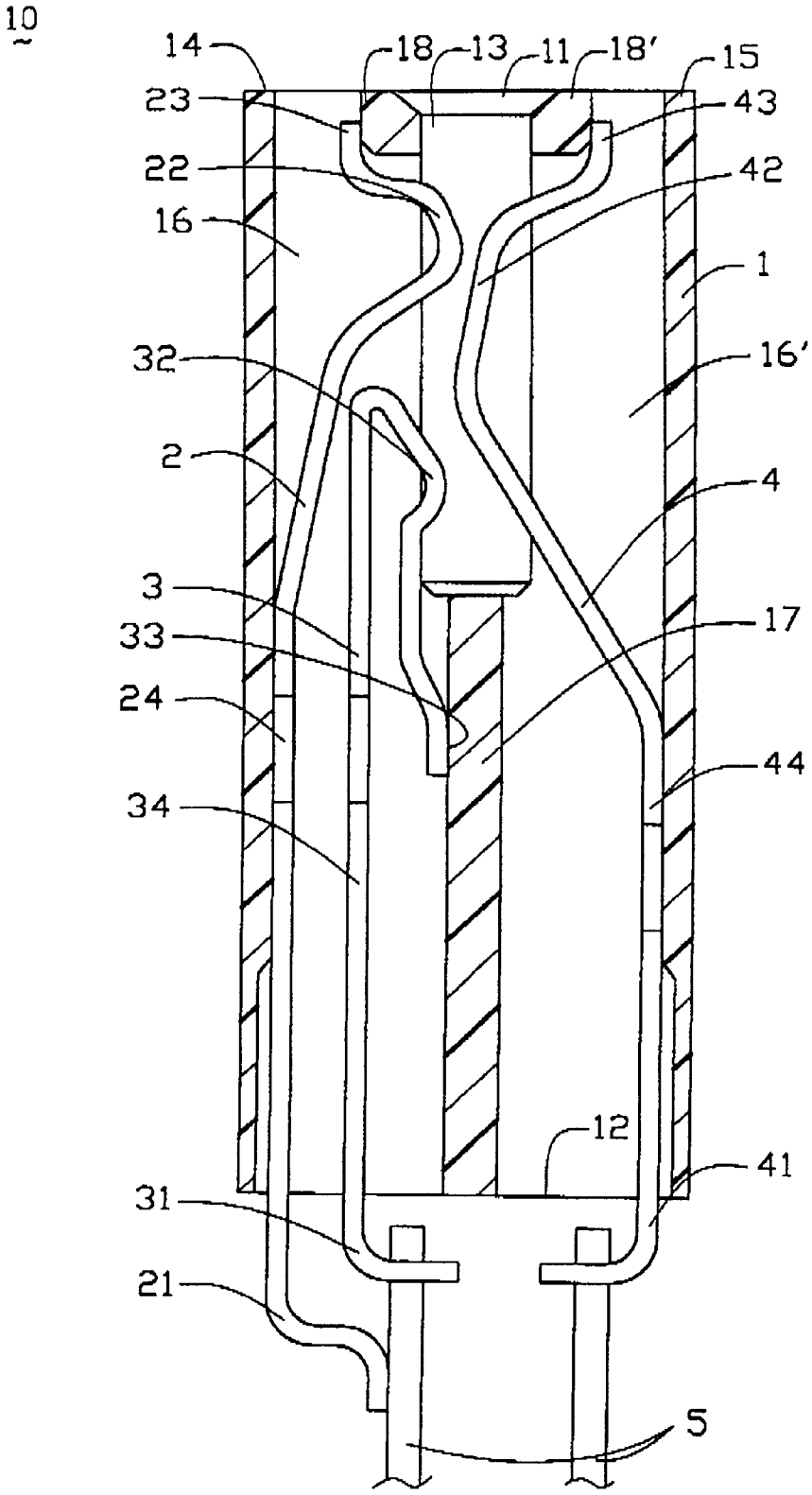
FIG. 3 is a cross sectional view of the connector of the present invention.

Also referring to FIG. 3, the connector 10 comprises an insulative housing 1 having a mating face 11 and a mounting face 12, a first contact 2, a second contact 3, and a third contact 4. An elongate slot 13 is defined in the mating face 11 for receiving the mating edge 60 of the circuit board 6. The slot 13 divides a portion of the housing 1 proximate the mating face 11 into an upper portion 14 and a lower portion 15, which further define a plurality of transverse cavities 16, 16' therein, respectively. Engaging portions 18, 18' are formed between the slot 13 and the corresponding cavity 16, 16'. The housing 1 also forms a separator 17 between the slot 13 and the mounting face 12.

Figure 4:
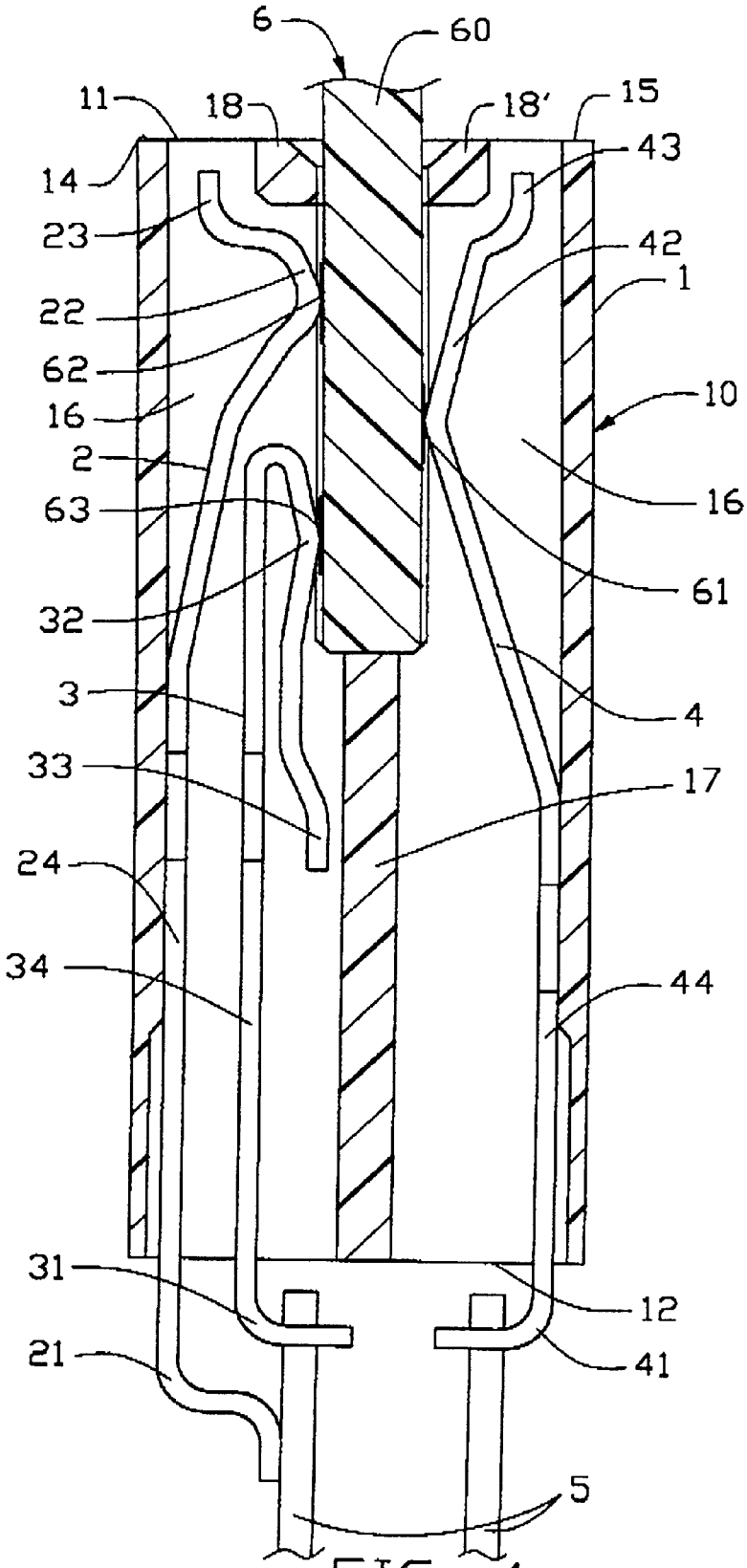
FIG. 4 is similar to FIG. 3 with the circuit board received in the connector.
Figure 5:
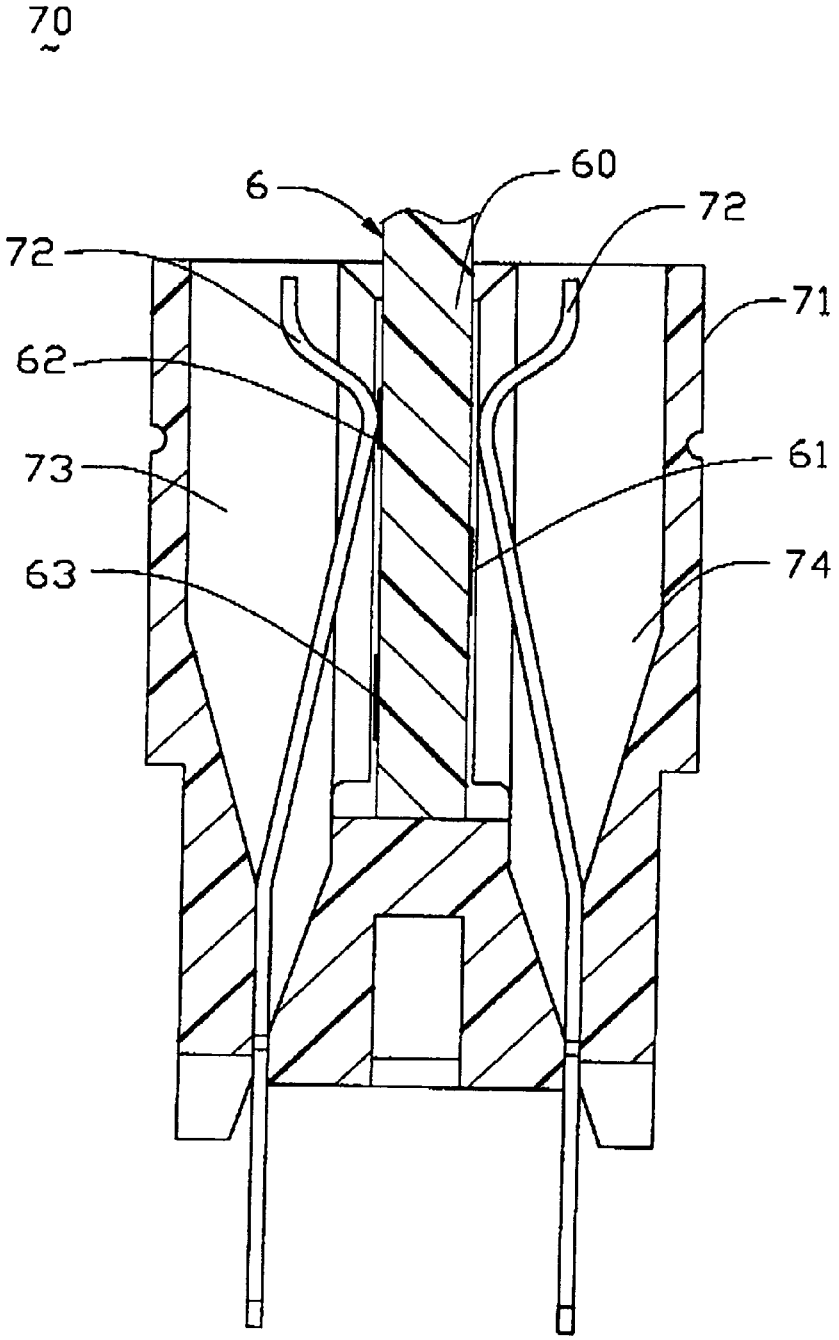
FIG. 5 (PRIOR ART)
FIG. 5 is a cross sectional view of a conventional connector engaged with a circuit board.
Figure 6:
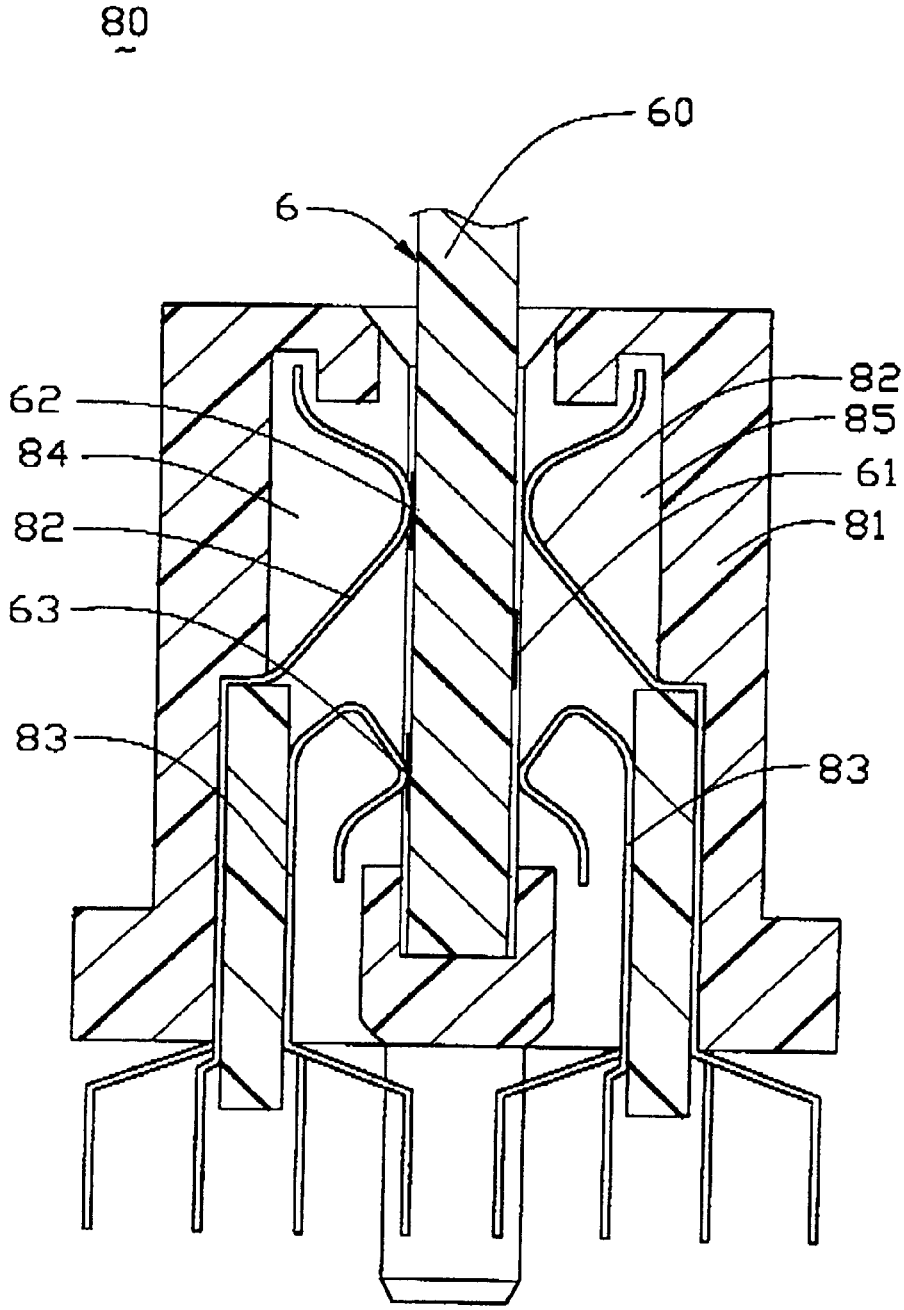
FIG. 6 (PRIOR ART)
FIG. 6 is similar to FIG. 5 showing a different conventional connector.

Referring to FIGS. 3 and 4, each of the first, second and third contacts 2, 3, 4 forms a soldering portion 21, 31, 41, a mating portion 22, 32, 42 and a mounting portion 24, 34, 44. The mounting portions 24, 34, 44 are received and fixed in the corresponding cavities 16, 16' of the housing 1. The soldering portions 21, 31, 41 extend beyond the mounting face 12 of the housing 1 and are soldered to the flexible circuit board 5. The mating portions 22, 32, 42 are received in the corresponding cavities 16, 16' with portions thereof extending into the slot 13. Free ends 23, 43 of the mating portions 22, 42 are bent to abut against the engaging portions 18, 18' respectively. A portion of the contact 3 proximate the mating portion 32 is bent substantially 180 degrees and a free end 33 of the mating portion 32 abuts against the separator 17 of the housing 1.

As the mating edge 60 of the circuit board 6 is inserted into the slot 13 of the housing 1 from the mating face 11, the mating edge 60 sequentially displaces the mating portions 22,42, 32. Accordingly, the free ends 23, 33, 43 of the mating portions 22, 32, 42 are displaced away from the engaging portions 18, 18' and the separator 17, respectively. The mating portions 22, 32, 42 firmly abut against the corresponding contact pads 62, 63, 61 after the mating edge 60 is completely inserted into the slot 13 of the housing 1.

It is noted that the apexes of the mating portions 22, 32, 42 of the three different contacts 2, 3, 4 are at different levels with regard to the mating face 11 of the connector 10, and also the contacts 2, 3, 4 are in a preloaded manner by means of engagement of the free ends 23, 33, 43 with the engaging portions 18, 18' and separator 17 for better mechanical performance. Under this situation, the mating portion 42 of the contact 4 extends into the slot 13 with a significant relatively larger dimension, at the middle level of the slot 13 with regard to the mating face 11, in comparison with the mating portions 22, 32 of the contacts 2, 3 at the upper and lower levels with regard to the mating face 11, wherein said mating portions 22, 32, 42 of the contacts 2, 3, 4 are offset from each other for not interference thereamong in both vertical and transverse directions of the mating face 11 of the connector 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector comprising:

an insulative housing defining a mating face and a mounting face on opposite sides thereof, an elongated slot defined in the mating face;

a plurality of transverse cavities defined by two sides of said slot;

a plurality of three different contacts positioned with the corresponding cavities, first contacts and second contacts being positioned on one side of the slot and third contacts being positioned on the other side thereof, and one first contact and one second contact commonly sharing one cavity with each other opposite to the corresponding third contact received within its own corresponding opposite cavity;

the first, second and third contacts having first, second and third mating portions, respectively, apexes of the mating portions of the three different contacts being positioned at different levels with regard to the mating face of the connector, and also all of the three kinds of contacts being arranged in a preloaded manner by means of respective engagement of free ends of the contacts with the housing for better mechanical performance; wherein the third mating portion of the third contact extends into the slot with a significant relatively larger dimension, at a middle level of the slot with regard to the mating face, in comparison with the first and second mating portions of the first and second contacts at the upper and lower levels with regard to the mating face, and wherein said mating portions of the contacts are offset from each other for not interference thereamong in both vertical and transverse directions with regard to the mating face of the connector.

* * * * *